US005596853A

United States Patent [19]

Blaney et al.

[11] Patent Number: 5,596,853

[45] Date of Patent: Jan. 28, 1997

[54] BUILDING BLOCK; SYSTEM AND METHOD FOR CONSTRUCTION USING SAME

[75] Inventors: Geoffrey W. Blaney; Richard R. Tangum, both of San Antonio, Tex.

[73] Assignee: Board of Regents, University of Texas

[21] Appl. No.: 411,547

[22] Filed: Mar. 28, 1995

Related U.S. Application Data

[63] Continuation of Ser. No. 953,672, Sep. 29, 1992, abandoned.

[51] Int. Cl.[6] ..... E04B 2/00; E04C 2/288

[52] U.S. Cl. ..... 52/223.7; 52/284; 52/293.3; 52/309.11; 52/309.12; 52/454; 52/612

[58] Field of Search ..... 52/220.2, 223.6, 52/223.7, 293.3, 295, 309.11, 309.12, 309.14, 309.17, 426, 427, 442, 284, 454, 612

[56] References Cited

U.S. PATENT DOCUMENTS

| | | | |
|---|---|---|---|
| 375,999 | 1/1888 | Jackson | 52/223.6 |
| 995,008 | 6/1911 | Jackson | 52/223.6 |
| 3,209,510 | 10/1965 | Nakanishi | 52/223.7 |
| 3,432,978 | 3/1969 | Erickson | 52/293.3 |
| 4,294,051 | 10/1981 | Hughes, Jr. | 52/223.7 |
| 4,489,530 | 12/1984 | Chang | 52/309.11 |
| 4,624,089 | 11/1986 | Dunker | 52/309.11 |
| 4,651,485 | 3/1987 | Osborne | 52/220.2 |
| 4,694,624 | 9/1987 | Juhas | 52/223.7 |

FOREIGN PATENT DOCUMENTS

| | | | |
|---|---|---|---|
| 1539431 | 9/1968 | France | 52/223.7 |

*Primary Examiner*—Michael Safavi
*Attorney, Agent, or Firm*—Arnold, White & Durkee

[57] ABSTRACT

A building block, and a system and method for constructing a building envelope using a plurality of building blocks, roof panels, and trusses. Each building block may be pre-fabricated and stacked upon one another at the construction site. The blocks and roof system may be rigidly coupled together to form a building using a plurality of connecting lines placed through conduits within each building block. The connecting lines are tensioned to couple each building block to an adjacent block, foundation, and roof system of the building. Each building block includes a core which is preferably insulating, and has a pair of opposing surfaces. A plurality of cross struts are placed through the core with ends protruding from each surface. Conduit preferably attaches substantially perpendicular to each cross strut, and preferably substantially parallel to the core surfaces to retain a rigid structural panel formed about the conduit.

22 Claims, 17 Drawing Sheets

BUILDING BLOCK; SYSTEM AND METHOD FOR CONSTRUCTION USING SAME

This is a continuation of application Ser. No. 07,953,672, filed Sep. 29, 1992 now abandonded.

BACKGROUND OF THE INVENTION

1. Field of the Invention

This invention relates to a modular light-weight building block, and a system and method for construction using a plurality of the blocks.

2. Description of the Relevant Art

Modular commercial and residential buildings often use pre-fabricated wall and roof units assembled at the site to form a building. This building system approach can reduce construction time and improve quality, but the additional costs of special materials, trained assemblers and special equipment may nullify cost savings.

The on-site construction of a building wall generally takes weeks or months and requires heavy equipment, and the services of many skilled trades. A larger number of workers can be committed to shorten the construction time, but quality and safety generally suffer.

Precast concrete tilt-up wall construction requires placement of units with heavy equipment and skilled labor. Prefabricated concrete walls can be quite large and cumbersome, with dimensions often exceeding 10 or 15 feet. Conventional concrete tilt-up panels have relatively low energy efficiency and require additional material and labor from other trades to insulate and finish.

Wall sandwich panels are another form of the prefabricated wall unit. Preformed wall sandwich panels have a rigid insulation core covered by wood, wood products, steel, or aluminum sheeting. Utility installation in sandwich panels is often difficult. Heavy equipment or a specialized crew is often required for placement, and the panels have a lower resistance to fire than masonry.

Other conventional forms of wall construction such as wood/steel stud framing and masonry require many skilled trades to complete multiple layers of structural and finish materials. This procedure is time and cost consuming since each trade must finish its task before the other can begin.

Conventional roof systems generally include a collection of planar trusses covered with panels of plywood or chipboard and finished with tar paper and shingles. Significant time is required to align the trusses, nail the panels, and apply the finish layer. Quality of workmanship often suffers from the large number of operations required to complete the work and the unstable platform on which the work must be performed.

Conventional pre-fabricated and site-constructed building systems have structural problems as well. Most wall systems have strong base units (blocks or panels), but deficiencies in the connections between units lead to a lack of structural continuity and a weak overall structure. For example, individual concrete masonry units have relatively high compressive strength, but the finished wall has poor resistance to shear and bending. Dimensioned lumber studs in conventional "stick" construction are individually strong in compression, tension, shear and bending; however connections between panels are often weak in tension and bending. Precast tilt-up panels are designed to withstand high loads on individual panels during shipment, but overall structural integrity is determined by the strength of field welds on connecting tabs, which may be compromised by poor alignment or faulty welding under adverse environmental conditions.

Conventional roofing systems also exhibit structural deficiencies. Roofing panels are normally nailed or stapled to 2"×4" trusses. Resistance to uplift of the panels is limited by the shear forces between nails (or staples) and wood. Resistance to uplift and shear at the wall/roof interface is controlled by individual nails, staples, thin metal straps, and/or light metal connector plates. The wall/roof juncture often represents a weak link in the structural system.

The deficiencies of existing light construction systems become evident under two types of loads. First, slow settling or working of the foundation can introduce stress concentrations in the wall and at the wall/roof interface, eventually leading to shear failure with associated deformations. Severe dynamic loading, such as hurricanes, tornadoes, or earthquakes, can impose high level shear and bending loads on walls, leading to structural damage or collapse of the building. Alternately, the walls may remain intact while panels are pulled from the roof, or the entire roof may separate from the building and collapse on inhabitants.

In light of the short-comings of the existing techniques, new options have been developed in building construction to reduce cost, time, labor, and skill needed while increasing the reliability and quality of the finished product.

In order to minimize the amount of skill and labor required to assemble and finish a wall at the job site, small building blocks are often used. These blocks may be stacked adjacent to one another to form a wall. Generally, each block is made of an insulating foam material attached together with fasteners or rods placed between or within each block. The fasteners or rods are often placed through the insulating foam material securing each block to an adjacent block and to a foundation upon which the wall of blocks resides.

To provide proper coupling between blocks, the fasteners or rods may be aligned through conduits placed at the centerline of each block. The fasteners or rods are made of rigid material extending generally the height or width of each block. The irregular shape of some blocks causes problems in alignment of rigid fasteners or rods through the conduit to a point of affixation. Moreover, fasteners and rods are often placed through the block centerline and within the less dense foam insulating material thereby presenting a support framework which bears on material lacking proper internal support or rigidity. Compression forces acting at one or more stress points within the surrounding wall may cause distortion or buckling of the less dense insulating material, possibly leading to serious damage to the entire structure.

Another difficulty with conventional forms of building blocks is their inability to be quickly and simultaneously secured together using selective tensioning of the blocks to adjacent blocks between the roof and foundation of the ensuing building. Placement and coupling together of blocks to form a wall has been difficult due to the complications that can arise when the blocks are not properly constructed. Thus, while pre-fabricated blocks of smaller geometry may be preferable over pre-fabricated panels or entire walls, the internal structure and geometry of conventional blocks, and the shortcomings or coupling systems, make them non-suitable for permanent fixtures exposed to severe loading conditions.

Light-weight panels have also been developed for roofing systems. The panels often comprise a planar section of light-weight insulating material sandwiched between two pieces of plywood or other structural material. One major drawback of this system is compression and creep of the insulating material over time.

SUMMARY OF THE INVENTION

The problems outlined above are in large part solved by an improved building block and roof anchoring system, and a system and method for constructing a wall or building using a plurality of said blocks. The building block described herein provides a light-weight, geometrically suitable design which may be quickly and easily coupled to an adjacent block, foundation or roof to form a resulting building of varying size or shape. While each building block may be of uniform shape, a plurality of blocks may be coupled to form external and internal walls of varying sizes or shapes suitable for permanent residential and light commercial buildings. Each building block contains core material which is preferably insulating, and which is surrounded by rigid support material to which internal coupling and support is maintained. Instead of supporting fasteners or rods placed within less dense insulating material incapable of rigid internal support, coupling using the present design is placed within a rigid structural panel support material on opposing sides of the insulating core material. In addition, building blocks described herein can be manufactured as corner blocks, blocks having plumbing and/or electrical outlets, and arranged in proper fashion to allow windows or doors to be placed within the ensuing wall and electrical and/or plumbing access therein. Light-weight structural roof panels of the invention may be easily placed between trusses, and tensioned in place. Subsequently the panels may be filled with insulation and finished with conventional roofing material.

The structural short-comings of conventional systems are reduced in the modular light-weight building block and system. The load capacity of the blocks in compression is more than adequate for two-story light construction. Tensioning the blocks and top-coating them with high-strength surface bond creates a monolithic panel with high compression shear and moment resistance. Tensioning vertical lines (e.g. cables or wires) continuously from the foundation through the walls and roof, and horizontally around the structure, assures that no part of the structure will move with respect to another because of a slow building of stress or rapid loading from a storm or earthquake. The collection of individual light-weight masonry components and roofing panels becomes an integral unit-body building system similar to a wooden crate encompassed by steel strapping. The resistance of this building system to concentrated loads exceeds the strength of individual block and roof panel elements because the loads are distributed through structural connections.

Broadly speaking, the present invention contemplates a relatively lightweight building block comprising a core with a pair of opposing (e.g. planar) surfaces. A cross-strut or plurality of cross-struts may be placed through the core having terminal ends protruding from the planar surfaces. Attached to the cross-strut is a conduit, which, preferably, is tubular. The conduit is preferably attached to the terminal ends of the cross-strut. The conduit may be coupled to the planar surfaces by a structural panel formed about the conduit and attached to the planar surfaces. The building block may further comprise a reinforcing (e.g. mesh) material coupled to the conduit to securably receive the structural panel. The core material is preferably constructed of a one-piece rigid insulation material, whereas the tubular conduit is preferably constructed of a plastic high tensile and compressive strength tube, and the structural panel is preferably made of light-weight concrete.

The building block may also comprise a core with non-planar surfaces. The surfaces may be cylindrical, spherical, or any other irregular shape. Cross-struts may be placed through the core, and conduits attached to the cross-struts and surrounded by a structural panel such that the conduits are essentially parallel to the surfaces of the core.

Building blocks of the present invention may be arranged adjacent one another and temporarily held in place using a tongue-in-groove arrangement. In particular, the insulating core may include a groove placed along the centerline of the core material at the perimeter of the core between the planar surfaces. The groove may accommodate a portion of a spline, wherein the other portion of the spline can be securably placed into an adjacent groove to complete a tongue-in-groove connection. The spline may be secured between adjacent blocks using construction adhesive.

The present invention also contemplates a system for constructing a building envelope. A "building envelope" is defined to mean a building component such as a floor, wall, roof, ceiling, or any combination thereof. For instance, a building may be built using a plurality of building blocks placed adjacent one another and stacked as a wall upon a foundation. Roof trusses and panels are then placed upon the block wall to complete the structure. Each block has a conduit substantially aligned with a conduit of an adjacent block such that a plurality of connecting lines may extend, preferably horizontally and vertically, through the conduit adjoining the building blocks together. The lines may then pass over a bearing plate across the surface of the roof plate and terminate at a ridge anchor plate.

According to one aspect of the present system a plurality of horizontal and vertical tensioning devices may be configured proximate the ensuing wall and roof for tensioning the horizontally and vertically extending connecting lines, respectively. Tensioning of the connecting lines simultaneously draws the adjacent blocks and roof panels together as a substantially structurally continuous wall and roof envelope upon the foundation. The wall maintains a rigid position between the foundation and roof. This wall has adjoining boundary separation crevices between blocks which may be covered by surface bond material placeable across opposing exposed surfaces of the wall.

According to another aspect of the present system, vertical tensioning systems may comprise a foundation connecting line anchor coupled to one end of the vertically extending connecting line and a ridge anchor plate with vertical tensioning and anchoring devices connected at the other end. The foundation connecting line anchor may include various geometric designs of U-shaped metal track such as substantially closed U-shaped metal track, a substantially open U-shaped metal track and/or a flanged U-shaped metal track. The configuration by which the vertical connecting lines are placed into the conduits depends upon which form of connecting line anchor is used. One form may be advantageously used to insert connecting lines through the external face of the wall, whereas another form would be preferred with connecting lines inserted through both internal and external faces of the walls. The ridge anchor plate is preferably a high-strength continuous member which distributes the line stress across the butt ends of the roof panels and trusses.

The present invention also contemplates a method for constructing a building using a plurality of block units arranged side-by-side. The method includes the steps of fabricating a plurality of building blocks including the substeps of shaping an insulating foam material into a slab having a pair of opposing (e.g. planar) surfaces. At least one cross-strut may then be placed into each slab such that the ends of the strut protrude from the surfaces. Tubular conduits are then attached to the ends of the struts substantially perpendicular to the strut and extending a spaced distance from and along the height and/or width of the slab surfaces. A structural panel may then be formed about the conduit and onto the surfaces to retain the conduit within a fairly rigid structural panel on opposing sides of the slab. The above steps can be repeated to form a plurality of building blocks which can then be coupled together to form a wall. The ensuing wall may also be simultaneously coupled to an adjacent wall and between a foundation and a roof of a building.

The fabrication procedure for non-planar blocks and walls may be similar. The insulating block core may be shaped into a non-planar shape, having a pair of opposing non-planar surfaces. One or more cross-struts may be placed through the core, with tubular conduits attached to the strut ends protruding from the core. The conduits may preferably be parallel to at least part of the surface of the core at their points of contact with the struts. A structural panel may be formed about the conduits, and the individual block units coupled together to form a wall.

According to one aspect of the present method, coupling of the building blocks and roof system includes the steps of threading horizontal connecting line and vertical connecting line through the conduit adjoining respective horizontally placed and vertically placed adjacent building blocks and over the structural roof panels. The structural panels are preferably filled with light-weight insulation material and closed with the top structural sheets prior to installation of the tensioning lines. Next, one end of the vertical connecting line may be attached to a stationary member proximate to or within the building's foundation while the other end is attached to a tensioning device placed proximate the apex of the building's roof. Likewise, one end of the horizontal connecting line can be attached to the external surface of a corner building block and the other end attached to a horizontal tensioning device placed proximate the outside surface of an opposing corner building block, door or window jam. Once the vertical and horizontal tensioning devices are actuated, the vertical and horizontal connecting lines are tightened, thereby completing coupling of the building blocks and roof together to form a structurally-continuous building envelope. Thereafter, surface bond material may be placed across exposed surfaces of the wall to grout adjoining building blocks and thus provide a durable impact-resistant finish to the building construction. The finished roofing surface (e.g. shingles, tiles) may then be applied to the upper surface of the structural roof panels to prevent the entry of water into the structure.

BRIEF DESCRIPTION OF THE DRAWINGS

Other objects and advantages of the invention will become apparent upon reading the following detailed description and upon reference to the accompanying drawings in which.

Figure 1:
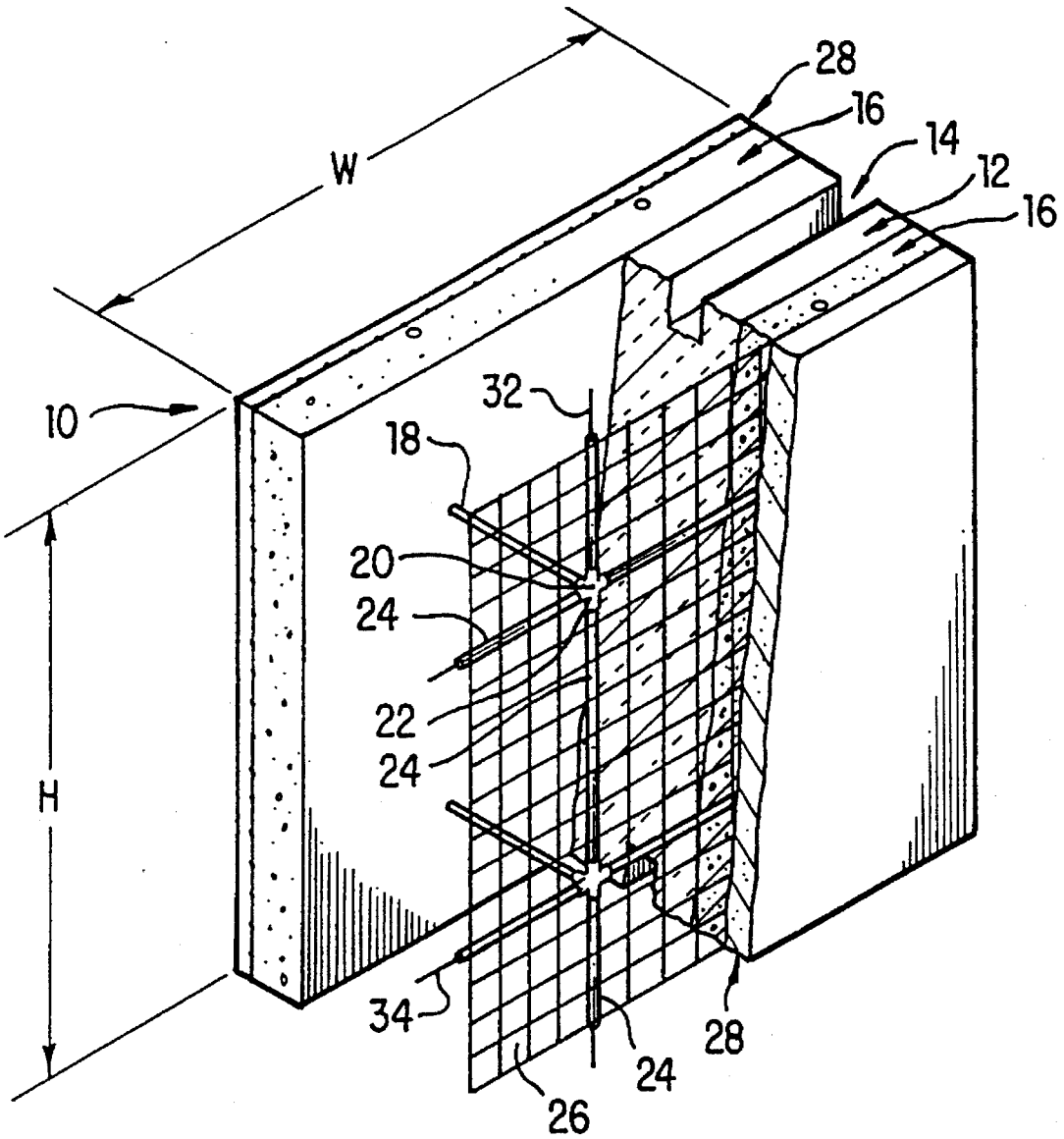
FIG. 1 is a partial isometric view of a building block according to the present invention.

While the invention is susceptible to various modifications and alternative forms, the specific embodiments thereof have been shown by way of example in the drawings and will herein be described in detail. It should be understood, however, that the drawings are not intended to limit the invention to the particular form disclosed, but on the contrary, the intent is to cover all modifications, equivalents and alternatives falling within the spirit and scope of the invention as defined by the appended claims.

DETAILED DESCRIPTION OF THE INVENTION

Turning now to the drawings, FIG. 1 illustrates a modular, pre-insulated, pre-finished building block 10. Block 10 comprises an insulating core material 12 having a groove 14 placed along the centerline and within the outer perimeter of core 12 between a pair of structural panels 16. A cross strut 18 is placed through core 12 such that the terminal ends 20 protrude outward from the outer surface of core 12. Attached to the terminal ends 20 of each cross strut 18 is a strut/conduit connector 22 which, when placed, extends outward from the opposing outer surfaces of core 12. A conduit 24, which may be placed horizontally and vertically, is preferably attached to strut/conduit connector 22 so that conduit 24 is attached substantially perpendicular to cross strut 18. Conduit 24 is preferably tubular. Conduit 24 may also be placed between the horizontal and vertical placements shown in FIG. 1 (e.g. conduit 24 may be placed diagonally). Moreover, conduit 24 is preferably substantially parallel to and spaced from the opposing outer surfaces of core 12.

A reinforcing mesh material 26 may be attached to the outer surface of conduit 24 to allow structural panel 16 to be formed between the outer opposing surfaces of core 12 and mesh 26. Once block 10, comprising core 12, panels 16, struts 18, conduit 24, and mesh 26 are placed as modular units adjacent one another to form a wall, a surface bond material 28 may be placed across the exposed surface of the formed wall.

An important advantage of the present invention is that block 10, with or without surface bond 28 and mesh 26, provides a moisture barrier which is both lightweight and highly insulative. The manufacture of block 10 is fairly simple and straightforward and can be achieved at the factory and then shipped to the site and placed together to form a wall or building. Manufacturing steps include forming the core 12 of insulation material such as, for example, expanded polystyrene (EPS) or extruded expanded polystyrene (XEPS). A mold may be used to form the insulation core. Alternatively, a large piece of EPS or XEPS may be cut using a hot-wire at selective regions in the piece to produce a resulting desired geometric shape. Using either a mold or hot wire, core 12 may be shaped into a slab having a pair of substantially planar opposing surfaces. Core 12 is preferably small in size so that one or two workers may easily lift and handle the ensuing block 10. Core 12 may have a nominal thickness, T, of approximately six inches with a height, H, and width, W, of approximately 2 ft.×2 ft. However, it is understood that any easily handled size or shape falls within the scope of the present invention, including a shape with surfaces that are cylindrical, spherical or other non-planar shapes.

Either expanded polystyrene or extruded expanded polystyrene may be used as the preferred insulation material for core 12. However, it is understood that other types of material may be used provided they are light-weight, and exhibit a high insulative and moisture barrier capacity with relatively low density. For example, if expanded polystyrene or extruded expanded polystyrene is used, the resulting density is approximately 2.0 pounds per cubic foot or less to provide an R value of approximately R-4 or greater per inch thickness. The block is relatively easy to make and results in a finished product of approximately 40 pounds for a 1'×2'×2' unit. EPS is manufactured by pouring small liquified granules or beads of polystyrene into a form and then heating the granules causing them to expand many times their original volume. The resulting expanded product is then dried to form a block which may then be cut or shaped to a desired geometry. A higher R-value (≦5) is obtainable when the material is extruded, thereby eliminating air voids. EPS can be obtained in any desired shape or form from U.S. Industries, Dow Chemical, and Amoco Foam Products.

Once core 12 is shaped to the desired configuration having necessary insulating/moisture barrier properties, a hot wire may be passed substantially perpendicular through the opposing planar surfaces of core 12 so as to form openings for the placement of each cross strut 18. Alternatively, the hole for the cross strut 18 may be drilled through core 12 without requiring use of a hot wire. Cross strut 18 can be made of any suitable, preferably non-metallic, rigid material, either solid or hollow. Once placed, strut 18 includes terminal ends 20 which protrude from opposing surfaces of core 12. A strut/conduit connector 22 is then affixed to each terminal end 20 to allow conduits 24 to be attached to strut/conduit connector 22 as shown. Similar to cross strut 18, conduit 24 may be made of any fairly rigid, preferably non-metallic, material. Preferably, a plastic tubular material having an approximate inside diameter of one-half inch may be used. Once attached, conduit 24 may be arranged substantially perpendicular to cross strut 18 so that it is spaced from the other surfaces of core 12 substantially parallel to those surfaces.

The fabrication procedure for blocks with non-planar surfaces parallels the procedure outlined above. An insulating core is cut or molded with finished surfaces substantially pointwise parallel to the desired outer surface of the finished block. The core is fitted with cross-struts passing between the surfaces of the core, and grooves for splines are cut in the ends. A conduit or conduits with shape substantially conforming to the surface of the block are then fitted to the struts.

A light-weight reinforcing mesh material 26 may be attached to the outer or inner surface of conduit 24 so that sufficient surface area is provided upon which structural panel 16 may bond between the opposing planar surfaces of core 12 and the surfaces of the planar mesh 26. The panel 16 may also encompass the mesh. Preferably, one side of block 10 is formed before the other side such that core 12 is placed having one planar surface below the other and resulting material of panel 16 placed horizontally over the upward exposed surface. The orientation of the structural panel with respect to the core, conduits and reinforcing mesh for the non-planar blocks is similar to the orientation of the structural panel for planar blocks. The method of fabrication is also similar.

The material of panel 16 is preferably cured on one side of horizontally placed block 10, and then the block is flipped over to expose the other surface of core 12 and allow pouring of material between that surface and mesh 26 spaced proximate thereto. After the material used to form panels 16 on both sides of core 12 has fully cured, block 10 is completed and can be shipped to the construction site.

In order that the finished block 10 be light-weight, material used in forming panel 16 is preferably a light-weight material such as concrete which includes cement, water, light-weight aggregate and/or chemical additives. The light-weight concrete is simply poured onto opposing surfaces of core 12 and held in place with the conduit 24 and mesh 26 during the curing process. Light-weight concrete is therefore preferably applied one side at a time and is formed around conduit 24 to hold conduit 24 in place proximate to and spaced from the opposing surfaces of core 12. Light-weight concrete spreads in a lateral fashion and is maintained flush with the outer edge or perimeter of core 12 so that the finished block 10 has somewhat flush or straight edges on all six sides. If core thickness is approximately 6 inches and panels 16 are each applied at approximately 3 inch thickness, the resulting overall thickness of block 10 will be approximately 1 ft. to provide an R value of at least R-30.

Furthermore, if the finished block 10 is made to have a geometry of approximately 1 ft.×2 ft.×2 ft., it will weigh approximately 40 pounds. Thus, one worker may easily grasp and handle the finished product and place that product within a wall structure of a building as described below.

Preferably core 12 is made of a lightweight insulating material that has a specific gravity of less than about 0.8, more preferably less than about 0.08, and more preferably still less than about 0.032. Preferably the lightweight material in the forming panel 16 has a specific gravity of less than 2.4, more preferably less than 0.8, and more preferably less than 0.4. If the core 12 and/or the forming panel 16 are too dense, then resulting blocks 10 tend to be too heavy when made in the larger sizes (larger sizes, such as planar surfaces including at least 4 square feet of surface area, are preferred to simplify construction). The densities of core 12 and panel 16 are preferably sufficient to maintain structural strength in core 12 and panel 16. An advantage of the invention is that the center core of the blocks may be made of insulating lighter, structurally weaker materials while the outer materials may be made of heavier stronger materials, thus providing building blocks that are relatively light-weight, insulating, moistureproof and strong. This particular arrangement of the block materials produces a unit with a relatively high moment of inertia to resist moment loads with respect to an in-plane horizontal axis, good impact resistance, and an overall high strength-to-weight ratio. Alternately, the core material alone may comprise a material that is relatively light-weight and strong, such as foamed concrete. This core material may encompass the cross-struts and conduits and be used directly to form a wall or building.

Figure 2:
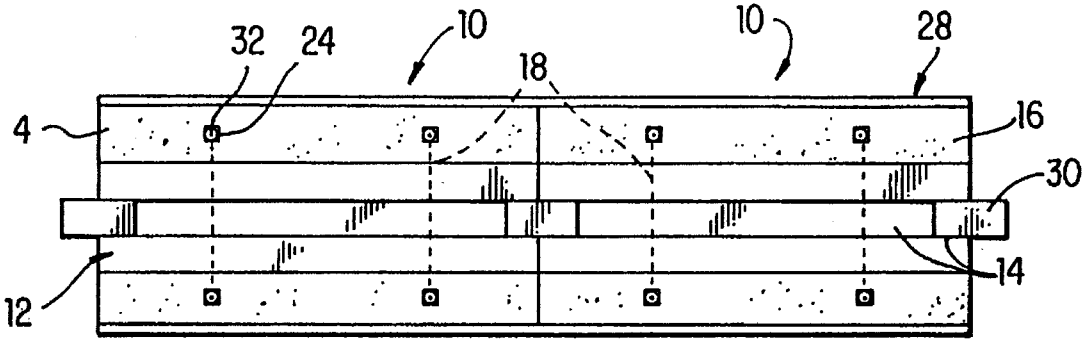
FIG. 2 a top view of two building blocks placed together according to the present invention.

FIG. 2 illustrates a top view of two building blocks 10 placed adjacent each other and coupled with a spline 30. Spline 30 may be composed of any insulating/moisture barrier material, and may be preferably made of the same material as core 12. Spline 30 is preferably of rectangular geometric shape having a portion of which is insertable along the longitudinal axis of spline 30 into groove 14. Spline 30 may be rigidly fixed within groove 14 using conventional contact adhesive such as, for example, Liquid Nails®. Thus, spline 30 serves as a tongue-in-groove attachment by which adjacent blocks can be coupled to form a stacked unitary structure.

Also shown in FIG. 2 are vertically extending conduit 24 into which vertical lines 32 may be placed. Embedded substantially within core 12 and fixed between conduit 24 on opposing sides of core 12 are a plurality of cross struts 18. Once building blocks 10 are adjoined, surface bond material 28 may be placed across the exposed wall formed by the attached blocks.

Figure 3:
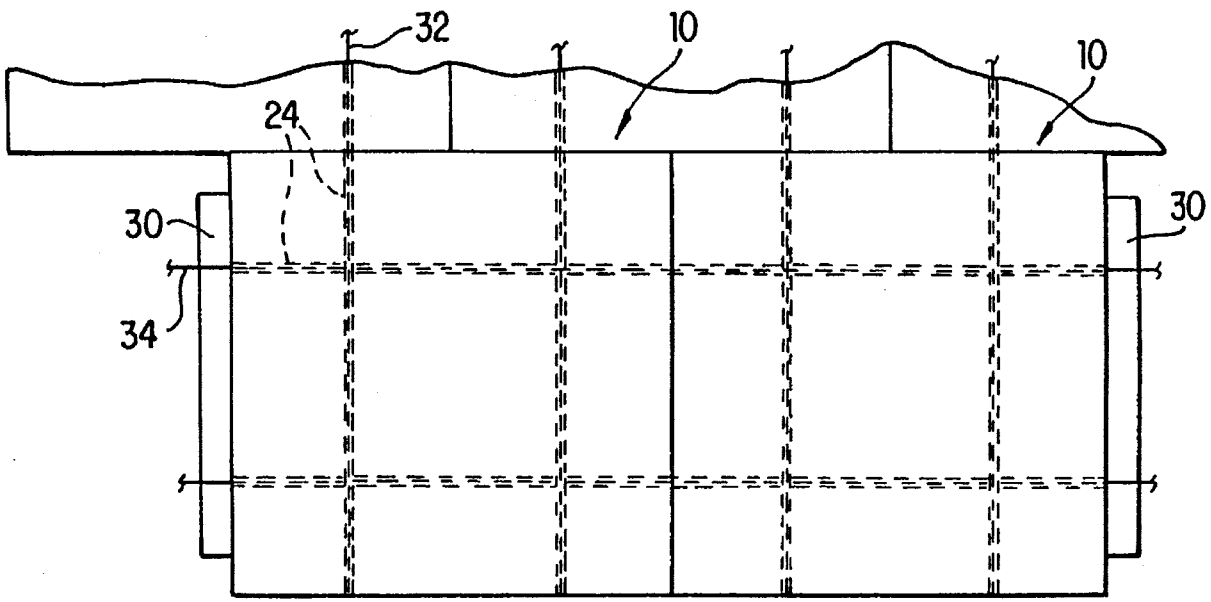
FIG. 3 is a side elevation view of two building blocks placed together according to the present invention.

FIG. 3 is a side elevation view of two building blocks placed adjacent each other and having spline 30 protruding from grooves formed around the perimeter or edges of each block 10. Conduit 24, shown with dotted lines, is embedded within each block 10 with the ends of each block's conduit substantially in alignment with and butting against or substantially adjacent to conduit of adjacent blocks. Thus, a continuous conduit is formed into which horizontal line 34 and vertical line 32 may be routed.

Figure 4:
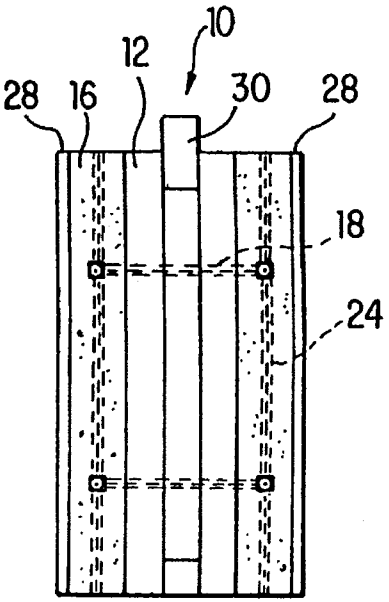
FIG. 4 is an end elevation view of a building block according to the present invention.

FIG. 4 is an end elevation view of building block 10 with a spline 30 placed along a horizontally configured groove at the top of one or more blocks placable adjacent each other. As shown, cross strut 18 connects a planer arrangement of conduit 24 placed within panel 16 spaced from opposing outer surfaces of core 12.

Figure 5:
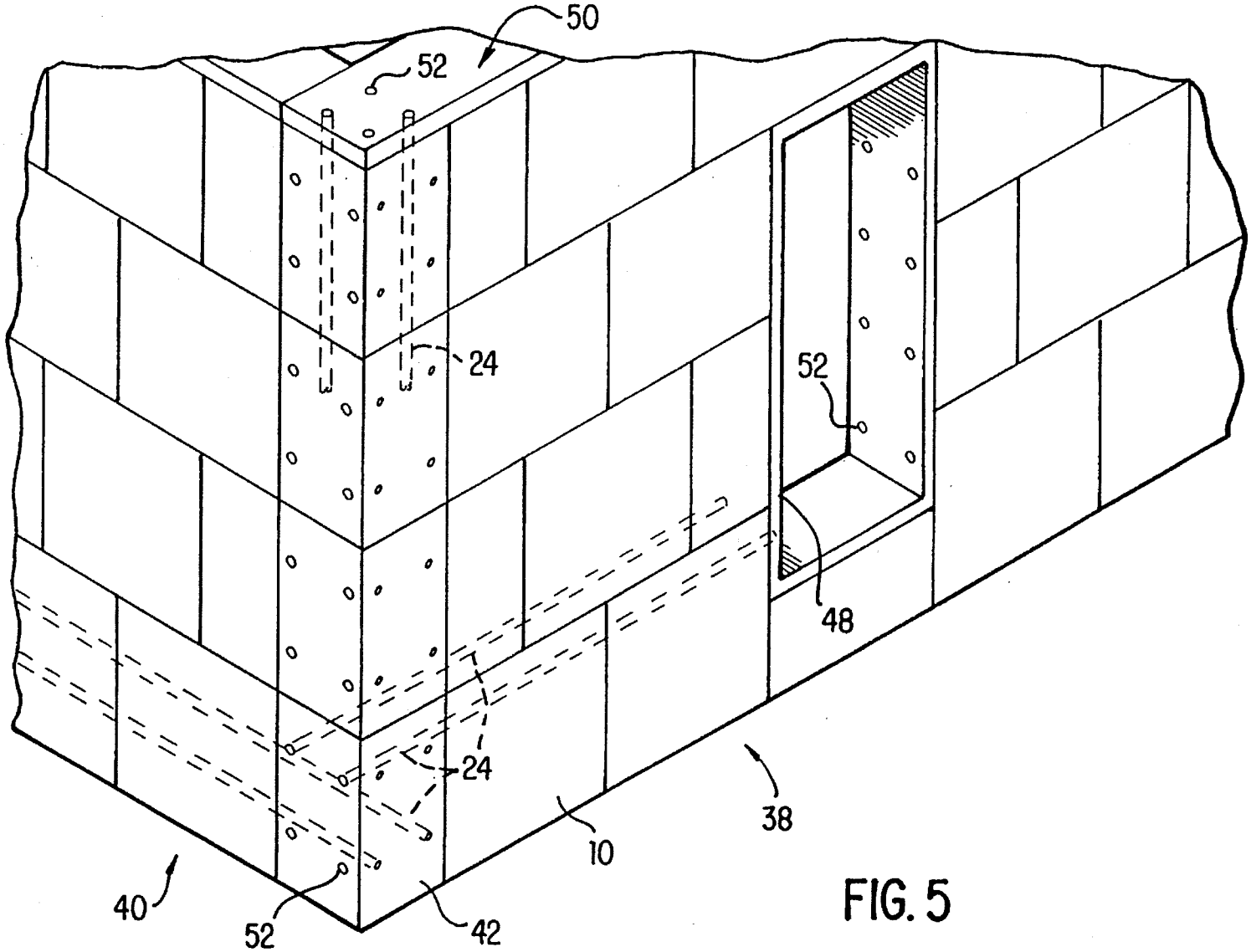
FIG. 5 is a partial isometric view of two walls of a building formed by a plurality of building blocks according to the present invention.

FIG. 5 is a partial isometric view of two walls formed by a plurality of adjacent blocks 10 in the present invention. One wall 38 is shown coupled to the other wall 40 by a column of stacked corner building blocks 42. Each corner block 42 having at least one conduit (shown by dashed lines 24) traversing block 42. At least one other conduit placed substantially perpendicular to conduit 24.

Corner blocks 42 thereby provide a solid pier or column attachable at the opposing run or link of either wall 38 or wall 40. Corner blocks provide a termination point for horizontally displaced conduits 24 by which lines placed within the conduit can be extended between a corner block 42 placed at one corner of the building and another corner block 42 placed at another corner of the building. As shown, conduit 24 extends between corner block 42 and a window/entry jam 48. Jam 48 includes a plurality of termination points or tension anchoring devices, similar to those of corner block 42, as will be described below. Window/entry jam 48 may be made of material common in the industry, such as 2 inch×12 inch wood, metal plate, etc. A caulking material can be inserted at the adjoining points between adjacent blocks 10 and jam 48.

As further shown in FIG. 5, a top plate 50 may be vertically placed above each of the plurality of adjacent blocks 10 configured at the top of walls 38 and 40. Plate 50 may also have a termination point or tension anchoring device 52 into which a vertical line 32 can be placed and subsequently tensioned. Placement and tensioning of lines at termination points 52 allow an ensuing wall formed by a plurality of blocks 10, including corner blocks 42, to be formed in a substantially rigid and continuous fashion having superior compressive and tensile strength, moment resistance, thermal mass, and insulative/moisture resistant characteristics.

Figure 6:
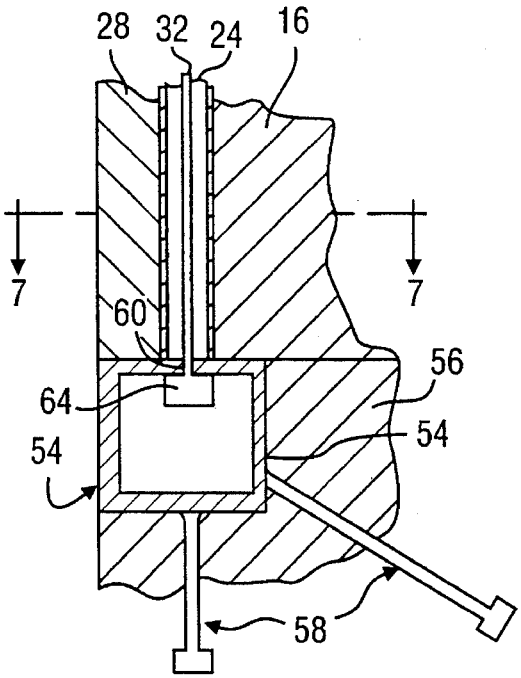
FIG. 6 is an end elevation view of an exterior foundation cable anchor according to the present invention.

FIG. 6 is a cross-sectional side view of a foundation connecting line anchor 54 mounted within a foundation 56 during the time in which foundation 56, generally comprised of structural concrete, is placed. Foundation connecting line anchor 54 may be formed as an elongated metal track extending flush with or slightly below the upper surface of foundation 56. According to one embodiment, the outer edge of foundation connecting line anchor 54 may be mounted flush with the outer edge of foundation 56, as shown in FIG. 6. Foundation connecting line anchor 54 is made of a fairly rigid material having superior tensile and compressive strength such as, for example, steel. Attached to or associated with anchor 54 is at least one anchor leg 58 which is preferably about several inches to one foot in length and may be deeply imbedded into the concrete of foundation 56 to provide rigid support for anchor 54.

Foundation connecting line anchor 54 has an elongated opening 60 through which vertical connecting line 32 extends from a chamber within anchor 54 and into conduit 24. By utilizing an elongated track, alignment with vertically disposed conduit 24 is easily achieved with conduit entry points disposed vertically above and adjacent to opening 60.

Figure 7:
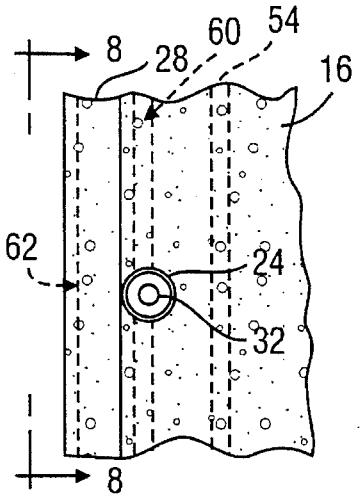
FIG. 7 is cross-sectional view along plane 7—7 of FIG. 6.
Figure 8:
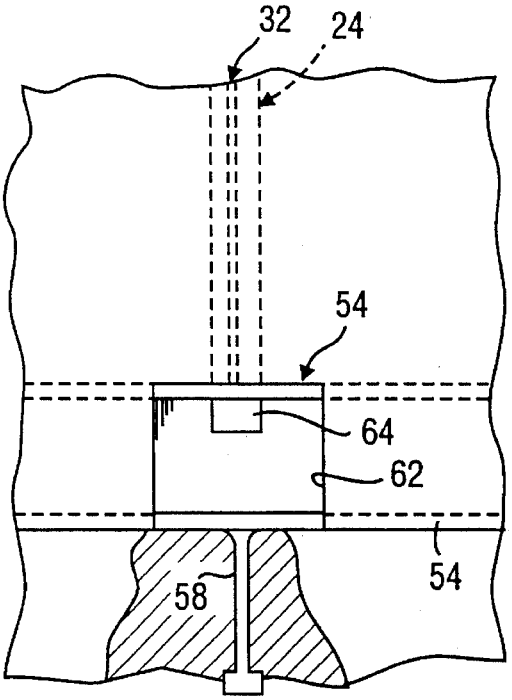
FIG. 8 is cross-sectional view along plane 8—8 of FIG. 7.

FIGS. 7 and 8 illustrate cross-sectional views of FIGS. 6 and 7, respectively. Anchor 54 is shown elongated in FIG. 7 with an elongated opening 60 arranged therethrough. An entry portal 62 may be formed into the side of anchor 54 if, for example, anchor 54 extends adjacent the edge of foundation 56. Vertical connecting line 32 may be threaded upward through portal 62, through opening 60 and into conduit 24. Connecting line 32 is fully threaded when the terminal connecting line end 64 abuts against the upper inside surface of anchor 54.

Figure 9:
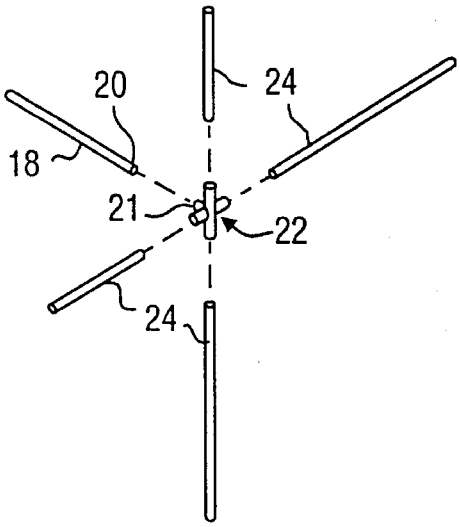
FIG. 9 is an exploded view of a cross strut and conduit connectable with a conduit/strut connector according to the present invention.

FIG. 9 illustrates an exploded view of a cross strut 18 having a terminal end 20 connectable within a female adapter 21 of strut/conduit connector 22. Various other ends of tubular conduit 24 can be attached within distal ends of connector 22 as shown. Vertical or horizontal runs of tubular conduit 24 may be press fit, glued, threaded or pinned into connector 22 to form a rigid lattice or matrix of horizontally and vertically extending conduit 24 arranged in a substantially planer fashion.

Figure 10:
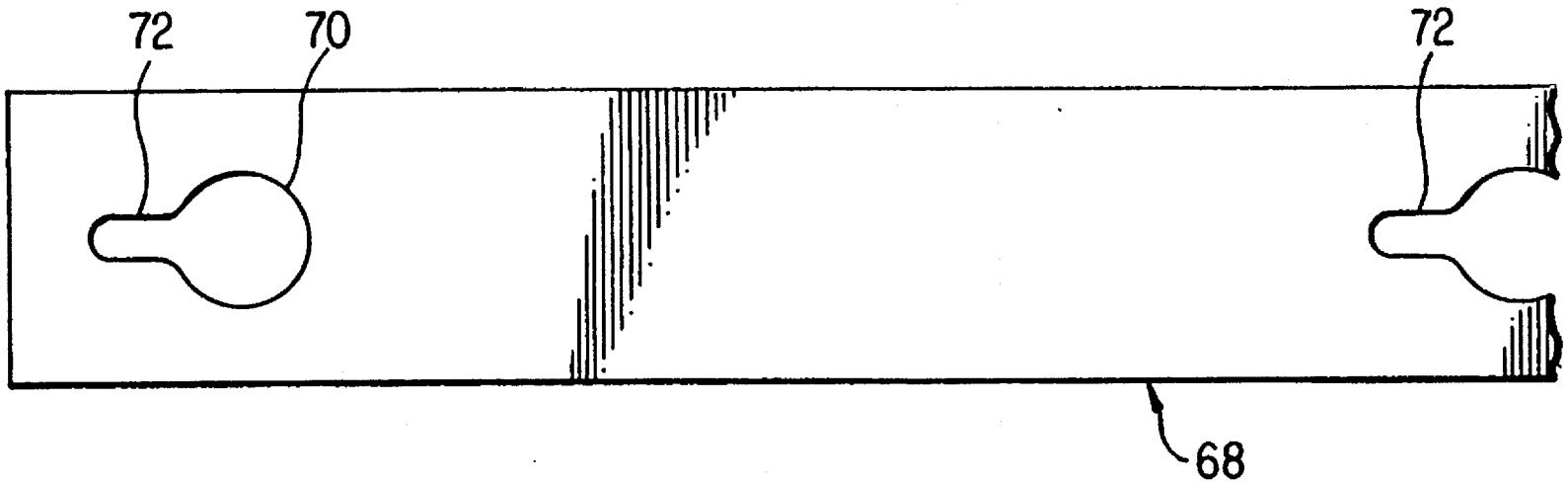
FIG. 10 is a top plan view of a double cable anchor plate according to the present invention.
Figure 11:
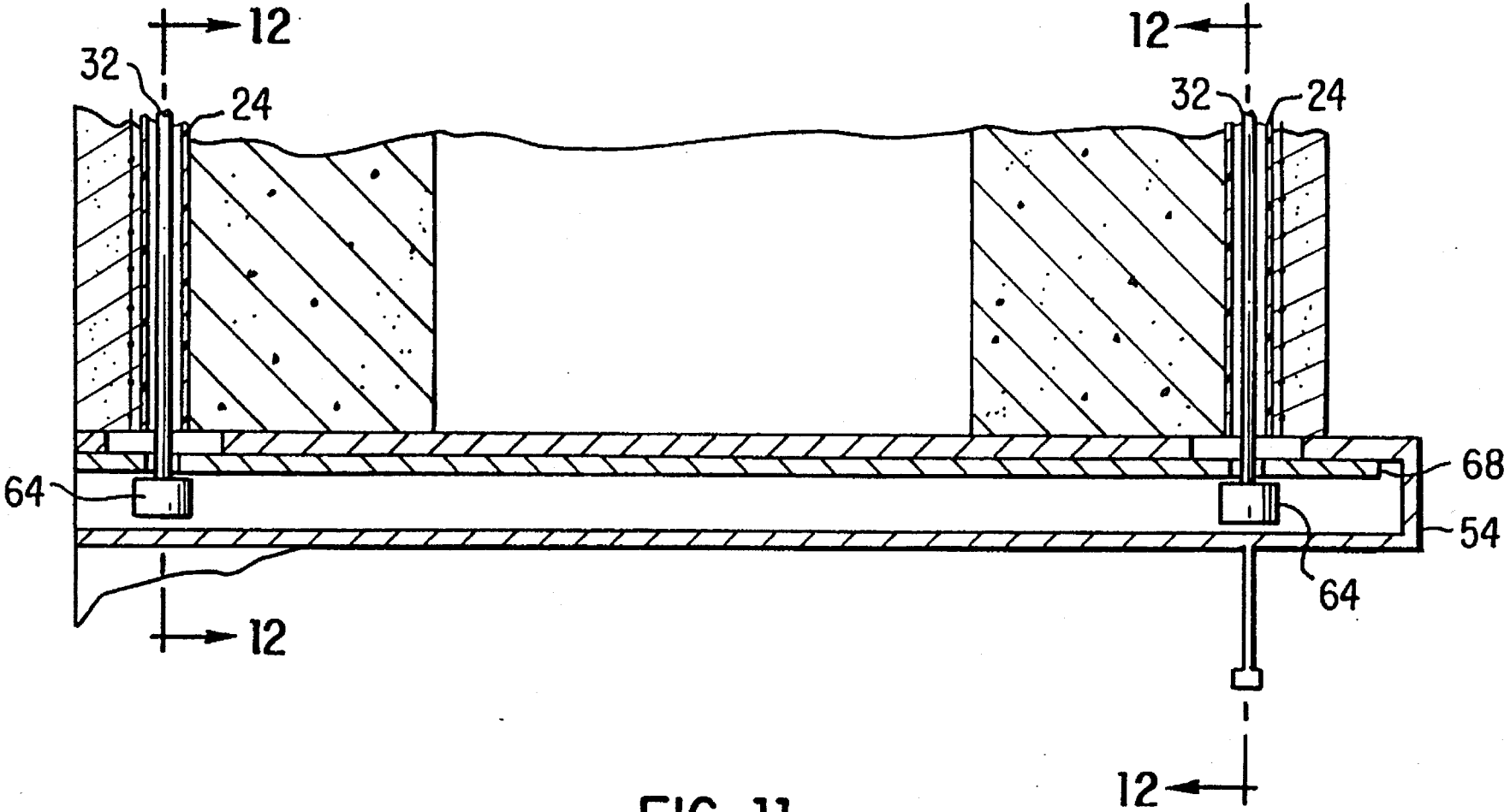
FIG. 11 is a side elevation view of a foundation cable anchor utilizing a cable anchor plate according to the present invention.

An alternative foundation connecting line anchor 54 may be used to connect a wall with internal lines to foundation 56. Such an alternative anchor 54 may employ an anchor plate 68 as shown in FIG. 10. Anchor plate 68, as shown in FIG. 11, is placed between terminal connecting line end 64 and the upper inside surface of connecting line anchor 54 along the track formed by anchor 54. The long axis of anchor 54 is substantially perpendicular to the vertical exterior surface of foundation 56. Anchor plate 68 merely slides in grooves within anchor 54 such that enlarged openings 70 are vertically aligned with vertically placed conduit 24. Vertical connecting line 32 may then be threaded from the top of conduit 24 with the terminal end 64 passing through enlarged opening 70 and abutting against the bottom surface of anchor 54. Next, to secure terminal ends 64, and attach connecting line 32 in place, anchor plate 68 is horizontally moved within anchor 54 to secure anchor end 64 below the flanges created by smaller opening 72. Smaller opening 72 is dimensioned such that terminal end 64 will not pull through opening 72 once anchor plate 64 is horizontally moved. In an alternate embodiment anchor 54 and plate 6B are aligned substantially parallel to the edge of foundation 56, extending the whole length of the foundation side. In this embodiment all lines on one wall section may be simultaneously anchored by horizontal movement of anchor plate 68.

Figure 12:
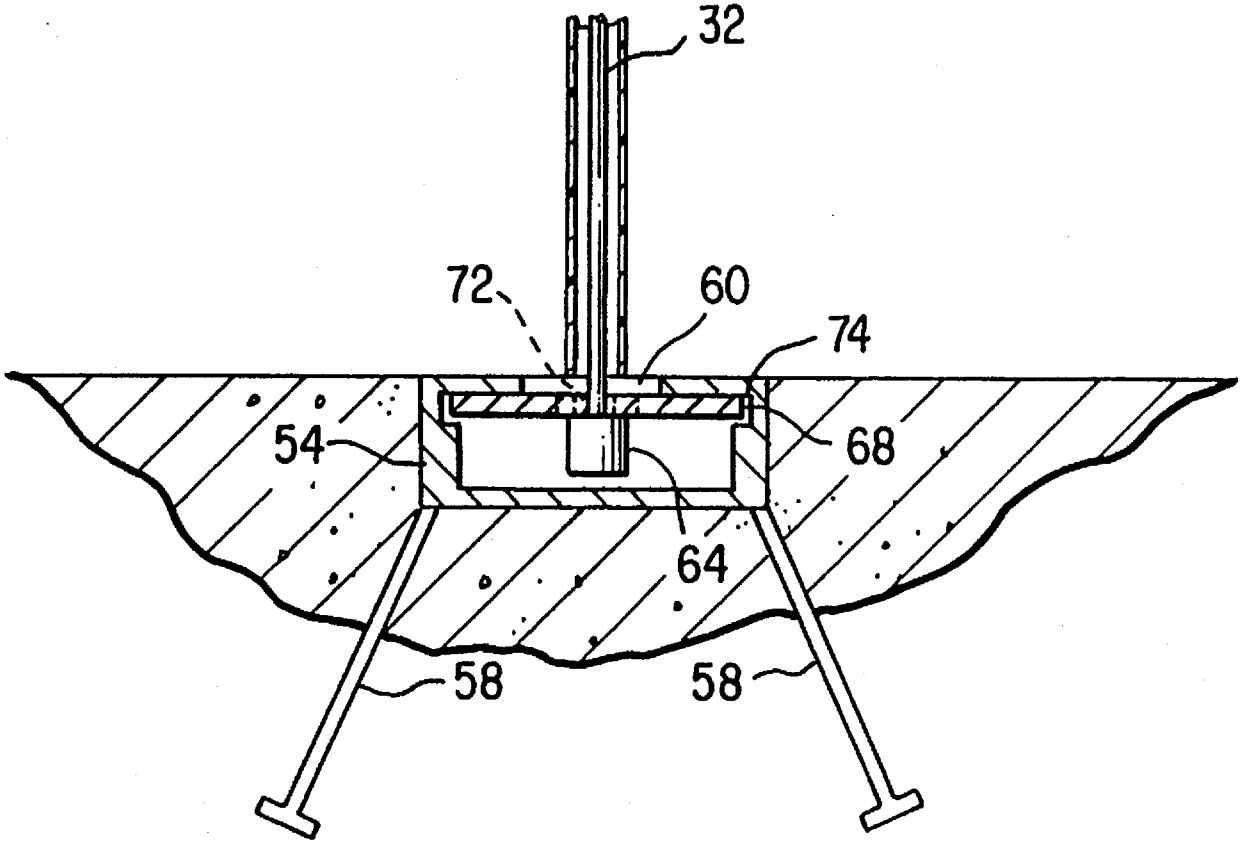
FIG. 12 is a cross-sectional view along plane 12—12 of FIG. 11.

FIG. 12 is a cross-sectional view of foundation anchor 54 having internal foundation anchor grooves 74 placed therein to vertically retain anchor plate 68. Terminal connecting line end 64 is configured having an upper surface abutting against the lower surface of anchor plate 68 with vertical connecting line 32 extending through smaller opening 72.

Figure 13:
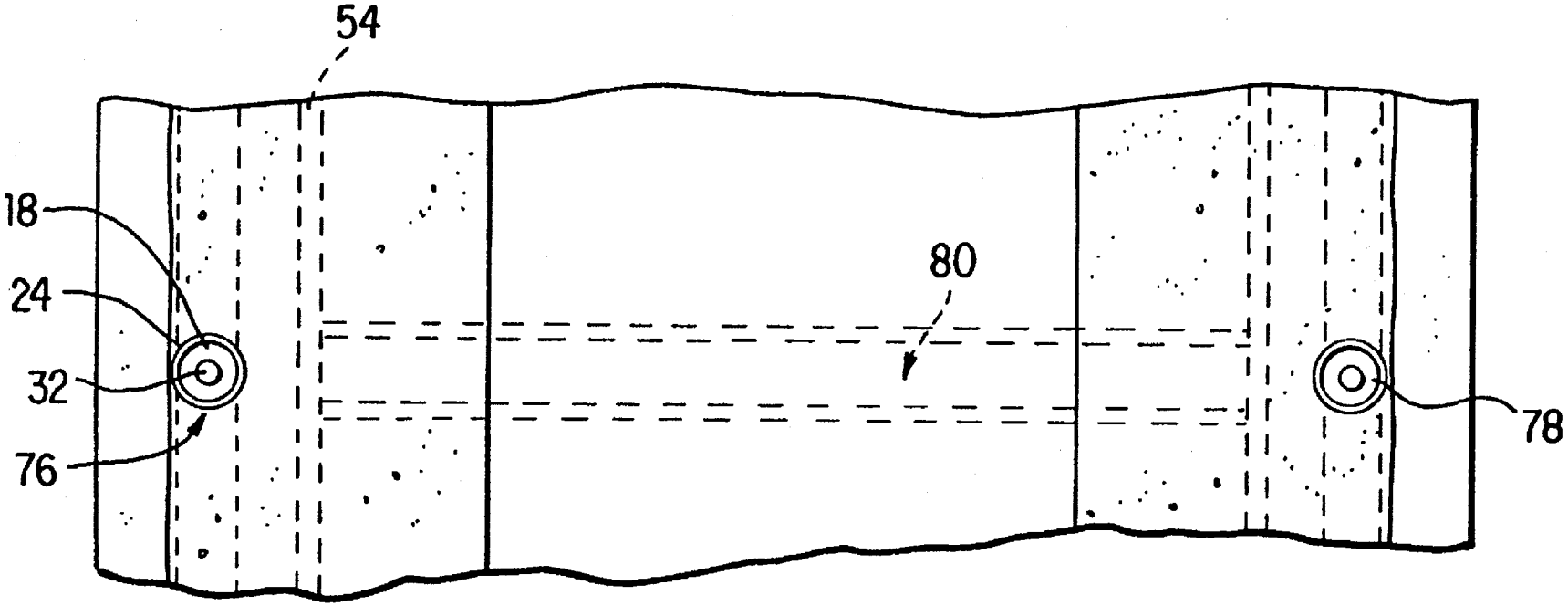
FIG. 13 is a top plan view of a foundation cable anchor utilizing a butterfly adaptor according to the present invention.
Figure 14:
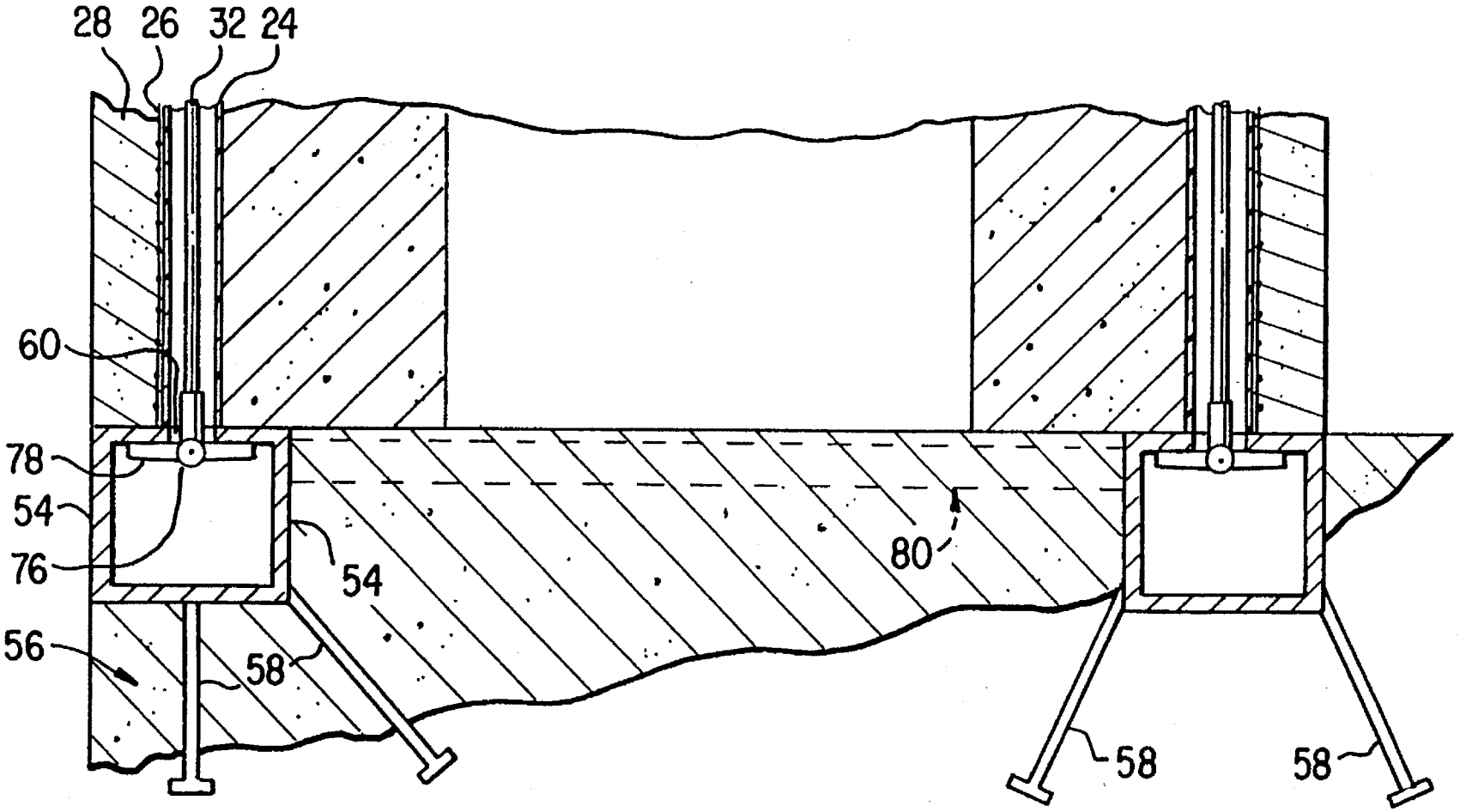
FIG. 14 is a side elevation view of a foundation cable anchor utilizing a double butterfly adaptor according to the present invention.

FIG. 13 illustrates still another embodiment of foundation anchor 54 utilizing a butterfly adapter 76. This anchor 54, like the anchor shown in FIGS. 10, 11, and 12, is used in cases where connecting line support is required on both the inner and outer surfaces of an exterior wall. Butterfly adapter 76 comprises one-way flanges 78 which are preferably compressed when threaded through conduit 24 but expand when they enter foundation anchor 54. Therefore, as shown in FIG. 14, vertical connecting line 32 may be threaded downward through conduit 24 having the distal end of connecting line 32 attached to butterfly adapter 76. Once adapter 76 extends within anchor 54, flanges 78 are biased outward via a biasing mechanism (not shown) to secure connecting line 32 within conduit 24. A cross brace member 80 may be attached to or formed as a part of substantially parallel elongated tracks of anchor 54. Member 80 extends substantially perpendicular between elongated anchors 54 similar to a ladder configuration. Member 80 may be placed periodically, for example, every 5 feet between substantially parallel anchors 54 to prevent anchors 54 from moving from their substantially parallel position when formed within foundation 56. Thus, members 80 help to maintain walls which are both straight and square with each other as is commonly found in well-built residential or light commercial buildings.

According to the various types of anchors 54, as shown in FIGS. 6–13, the internal cavity size and shape of anchor 54 is determined by the type of attachment used. For example, walls supported with lines solely on their exterior surface may utilize the substantially closed U-shaped metal track of anchor 54 as shown in FIGS. 6–8. Opening 60 may be fairly small when using the substantially closed U-shaped track to allow only passage of connecting line 24 while preventing passage of end 64. Walls supported by lines on their exterior and interior surfaces may be secured using anchor plate 68 as shown in FIG. 10. Connecting line 24 may be inserted downward through the wall where it is then secured using plate 68. Anchor plate 68 may therefore be used with a more open U-shaped metal track as shown in FIG. 12. Still further, a flanged U-shaped metal track may be used with the butterfly line anchor as shown in FIGS. 13 and 14 having an opening 60 larger than the opening of the substantially closed U-shaped track shown in FIGS. 6–8, but smaller than the opening of the substantially open U-shaped metal track shown in FIGS. 11 and 12.

All anchor systems shown in FIGS. 6 through 14 may also be employed to anchor non-planar blocks 10 and wall sections 38, 40 or 42 to the foundation 56. The anchor casings 54 may then be fabricated with appropriate curvature to substantially follow the non-planar profile of the blocks and wall. Once placed in the foundation 56, the procedure for placing and tensioning lines 32 would be the same as described above.

Figure 15:
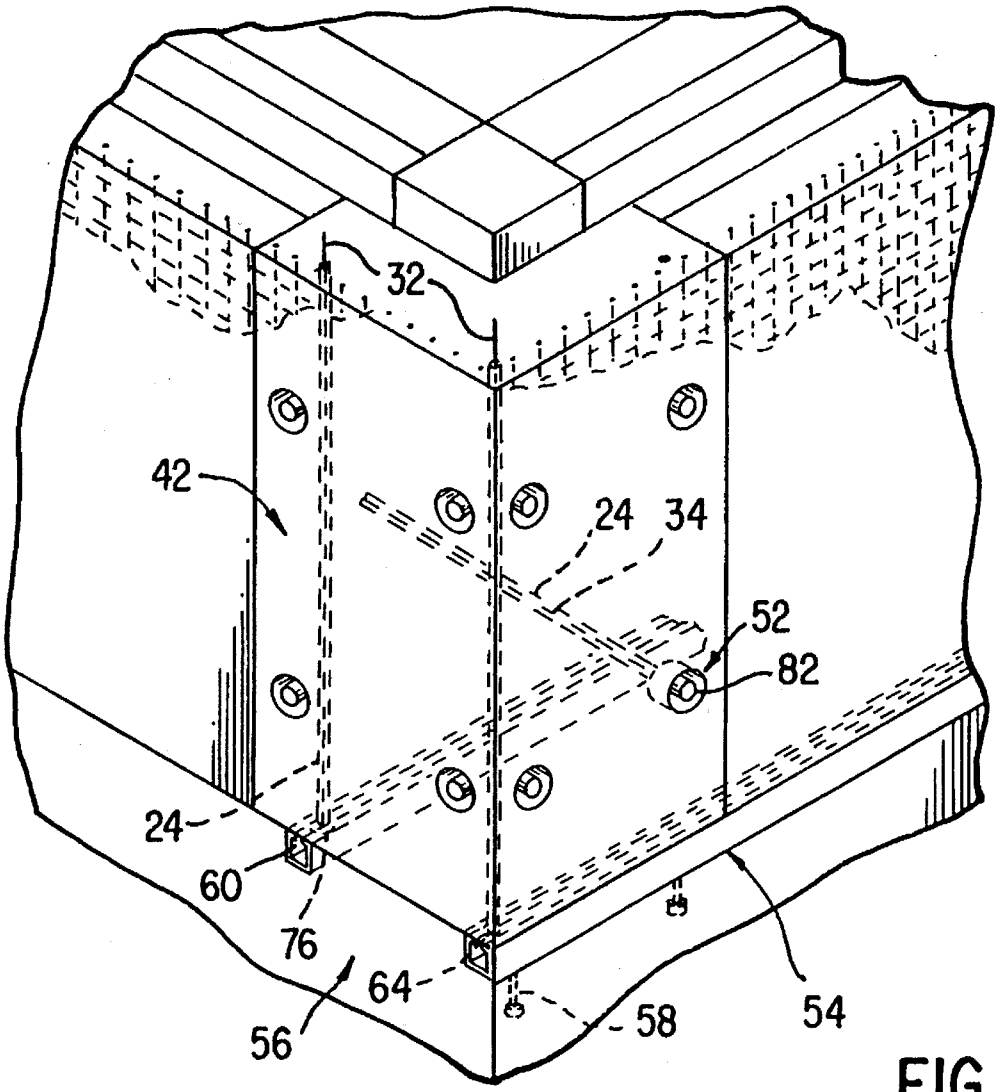
FIG. 15 is an isometric view of a corner building block with foundation cable anchors beneath said corner building block according to the present invention.

FIG. 15 illustrates a single corner building block 42 secured to foundation 56 using foundation cable 54. Anchor 54 is shown having anchor legs 58 and an elongated opening 60 through which terminal connecting line end 64 is insertable. Although various forms of insertion and attachment of connecting line end 64 fall within the spirit and scope of this invention, FIG. 15 illustrates one form utilizing butterfly adapter 76 used to secure connecting line end 64 within anchor 54. Vertical connecting line 32 placed and tensioned within conduit 24 insures that corner building block 42 remains secured to foundation 56. Moreover, horizontally extending conduit 24 and horizontal connecting line 34 secure horizontally adjacent building blocks 10 to corner block 42 as shown. Terminal point or tensioning device 52 insures that horizontal connecting line 34 is secure and tight between horizontally adjacent blocks. An appropriate tension-locking system would include a locking anchor device 82 which may anchor the end of connecting line 32 which has been tensioned by an appropriate tensioning device. One tensioning device 82 used is the Wirevise® made by Reliable Power Products (Franklin Park, Ill., U.S.A.).

Figure 16:
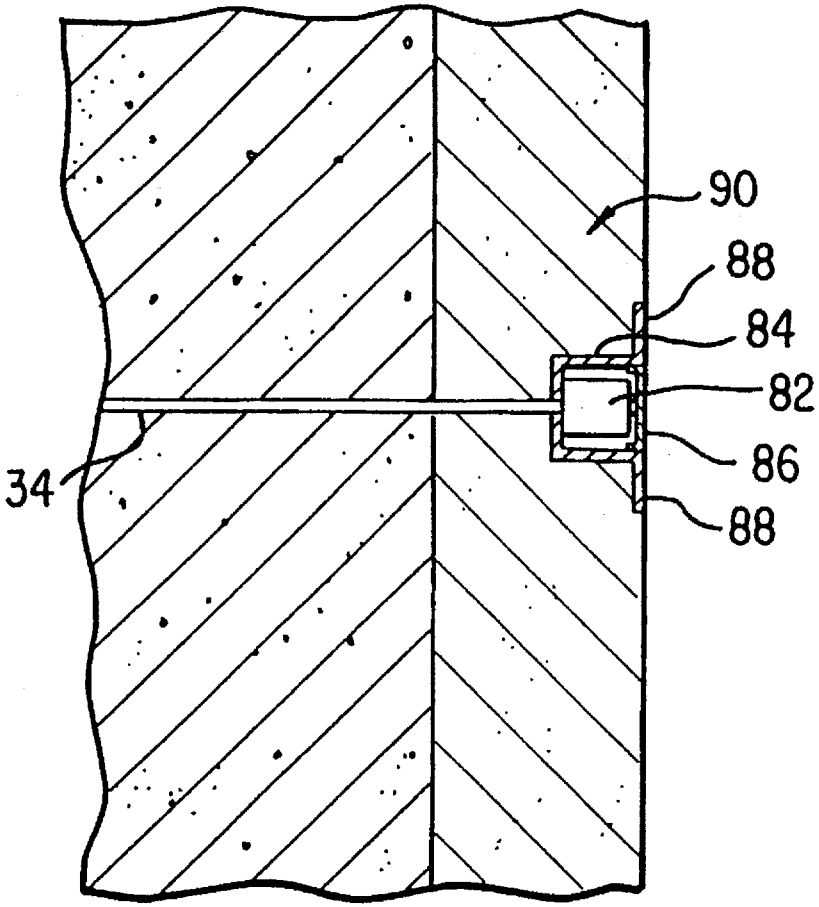
FIG. 16 is a side elevation view of a cable anchor according to the present invention usable on a window, door or top frame of a building.

FIG. 16 illustrates an anchor casing 84 which may be mounted with its outer surface or cap 86 flush with the wall top plate 50, corner surface, and window or door jam outer surface 90 formed within a wall of the present invention. Flush mount anchor casing 84 which houses terminal connecting line end 64 or locking anchor device 82 is preferably used to maintain aesthetics of the lateral or upper surface into which it may be placed. Accordingly, anchor casing 84 which tightly holds or anchors horizontal connecting line 34 is advantageously used to prevent unsightly connecting line end 64 protrusions from the outer surface of, for example, corner blocks 42, upper surface of upper blocks 10 and/or window or entry jams 48. Accordingly, anchor casing 84 may be countersunk within wood or light-weight concrete. Anchor casing 84 includes flanges 88 which distribute pressure over the face of the surface material 90. An anchor cap 86 may be placed over casing 84 to hide connecting line end 64.

Figure 17:
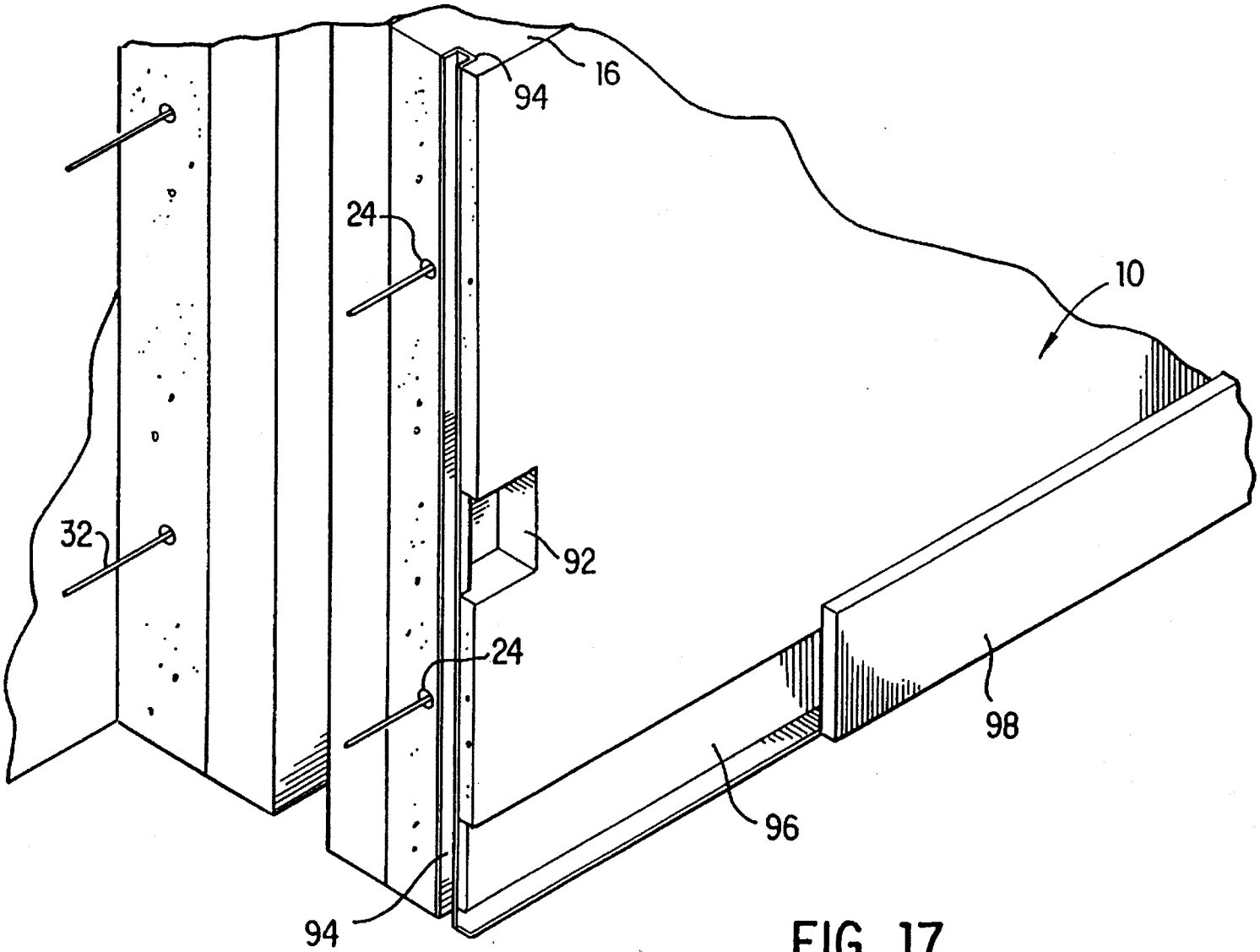
FIG. 17 is an isometric view of utility conduit and utility box within a building block according to the present invention.

FIG. 17 illustrates the various types of modifications that may be made to each modular building block 10 depending upon what type of utility line is placed within the block. If block 10 is to contain electrical wires necessary for an electrical outlet 92, then an electrical conduit 94 may be secured within light-weight concrete of panel 16 similar to tubular conduit 24. Electrical conduit 94, as well as outlet 92, may be placed near one edge of block 10 so that electrical wires (not shown) may be routed from an external source through horizontal utility channel 96 and then vertically upward to outlet 92 via electrical conduit 94. Thus, a version of block 10 may be fabricated for the bottom row of blocks utilized in a wall of the present invention. A base board 98 may then be placed over the horizontal utility channel 96 to cover utilities placed therein, such as, for example, horizontal electrical wires, gas lines, and fresh water lines.

Figure 18:
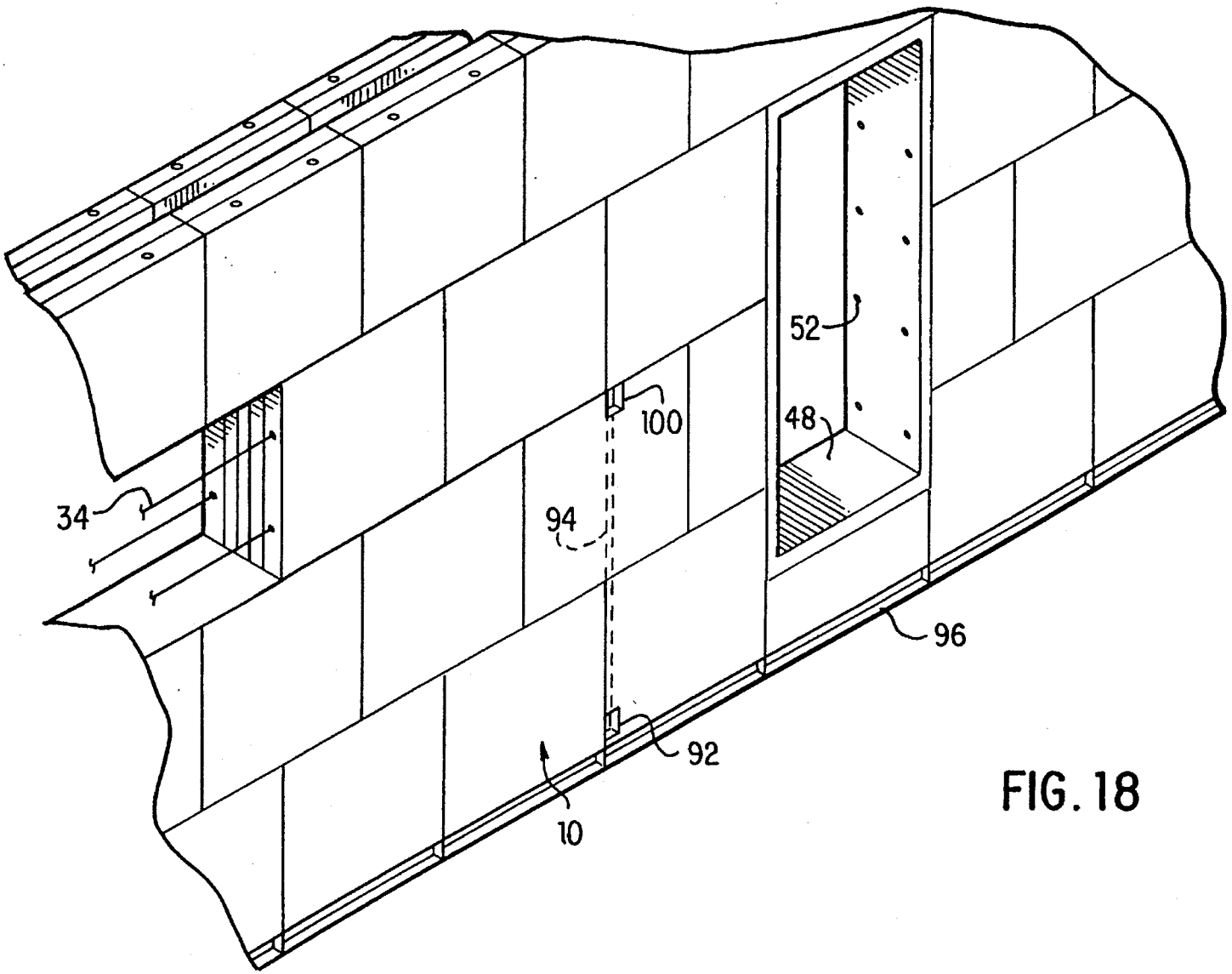
FIG. 18 an isometric view of plurality of building blocks, wherein selective blocks comprise a utility box or switch box within a wall of a building according to the present invention.

As shown in FIG. 18, building blocks 10 may be arranged in a staggered configuration with four horizontal and four vertical conduit 24 (and associated connecting line) placed within each block. Two vertical conduits associated with the left side of a block align with two vertical conduit associated with the right side of an underlying block such that one overlying block will couple to one-half of two underlying and two overlying blocks. The staggered configuration provides greater rigidity and shear strength to the ensuing wall than non-staggered blocks.

As further shown in FIG. 18, a switch outlet box 100, as well as socket 92, may receive electrical wire from horizontally and vertically extending conduit within the respective block 10.

Figure 19:
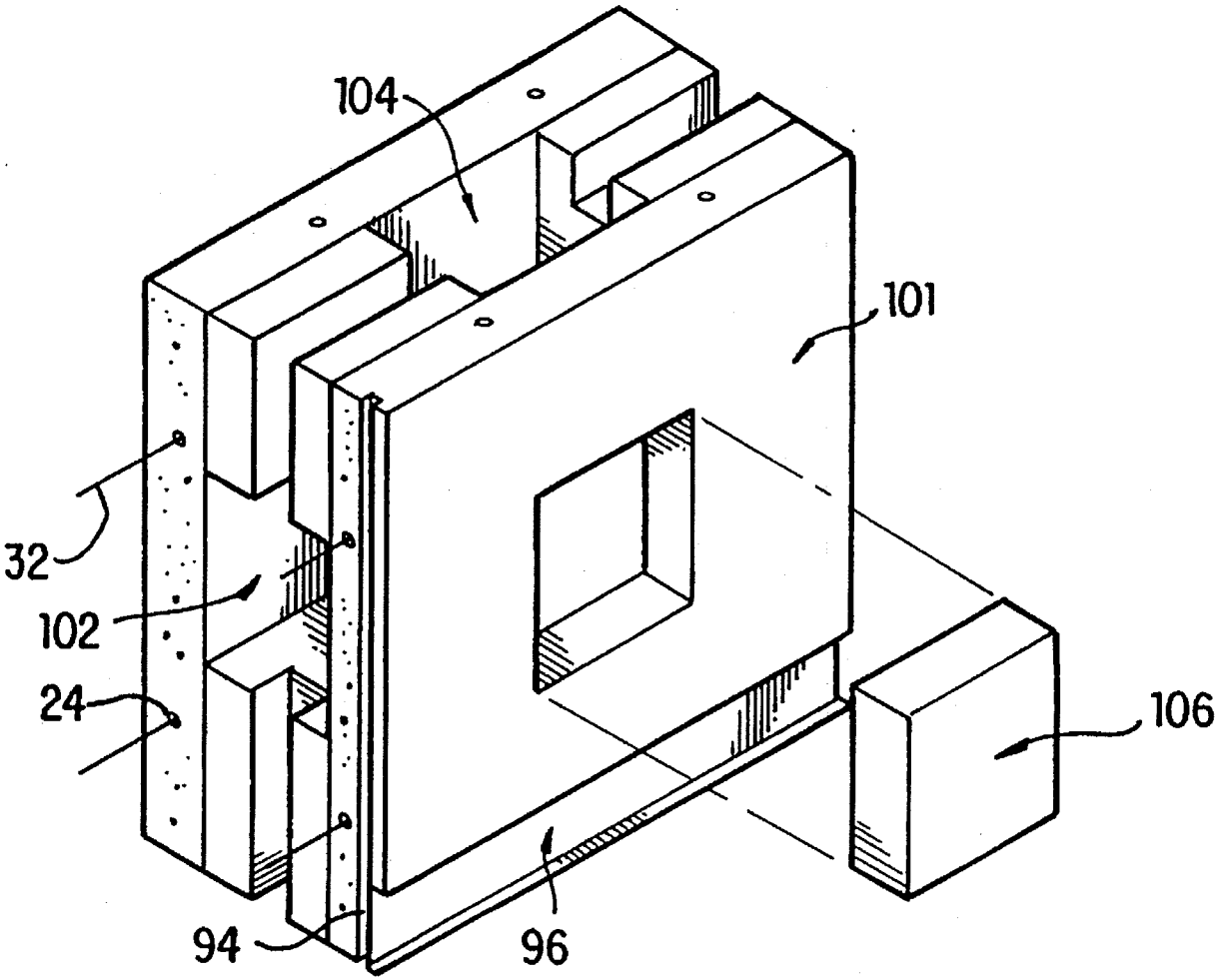
FIG. 19 is an isometric view of a building block including a plumbing access passage or vent passage placed within said block according to the present invention.

FIG. 19 illustrates a utility block 101 with horizontal and vertical access ports 102 and 104 placed through utility block 101. Block 101 is particularly suited to receive vertically extending or horizontally extending water supply, drain, and drain vent pipes. A portion 106 of one side of block 101 may be removed to provide access to water supply, drain, and drain vent pipes placed within horizontal or vertical ports 102 and 104.

Figure 20:
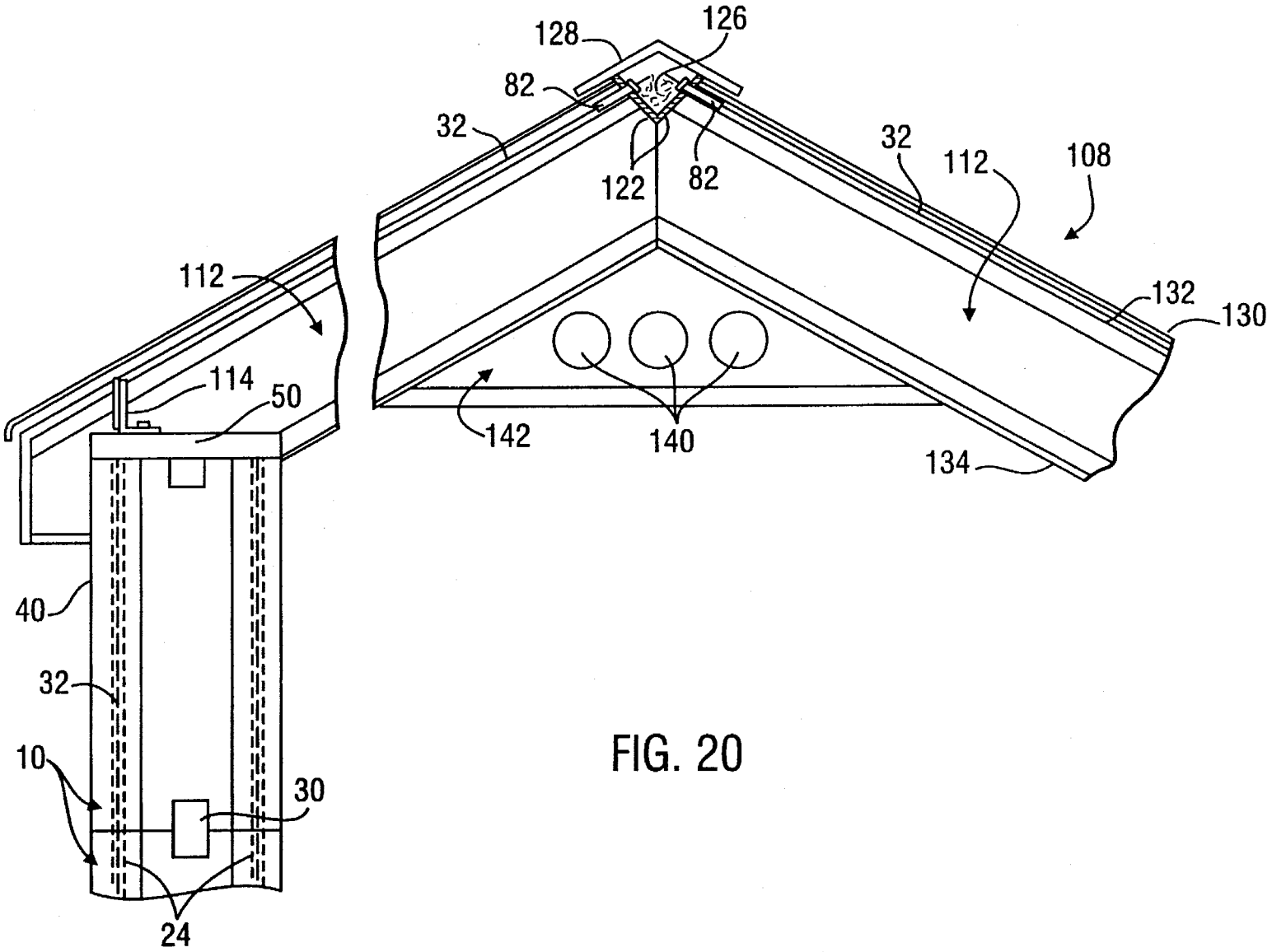
FIG. 20 is a cross-sectional view of a building roof section according to the present invention.

FIG. 20 illustrates a transverse section of a building roof truss 108. At the base of roof truss 108, and attached to the top of wall 40, is a wall top plate 50. Wall top plate 50 generally comprises an elongated piece of wood, preferably 2 inch×12 inch, of common configuration and design. As described above, wall 40 includes a plurality of stacked building blocks 10 having vertical connecting line 32 placed therethrough, as shown. Each building block 10 is stacked and placed adjacent each other using spline 30.

Figure 21:
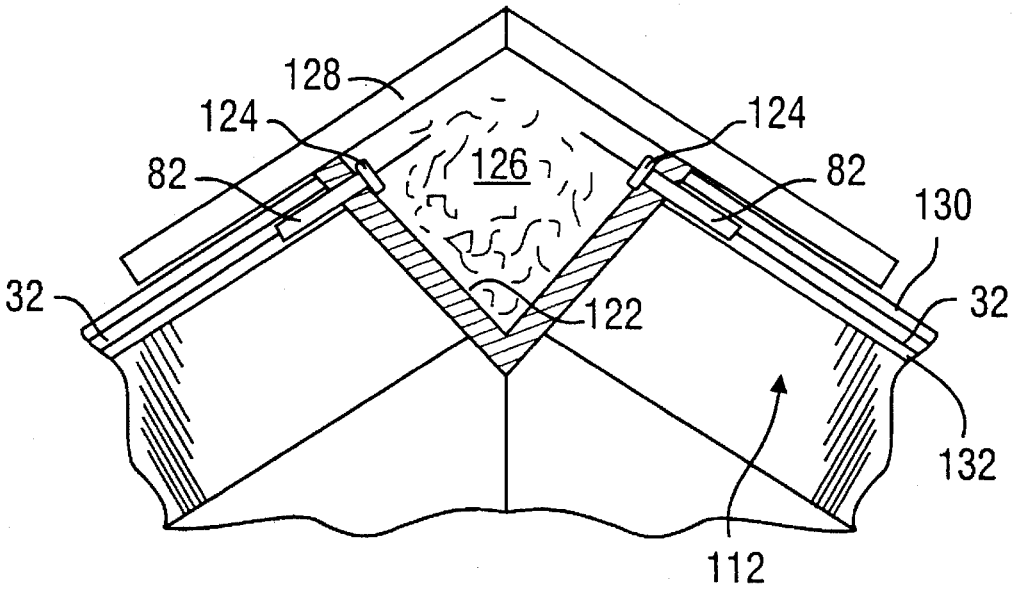
FIG. 21 is a detail view of the roof section of FIG. 20 according to the present invention.
Figure 22:
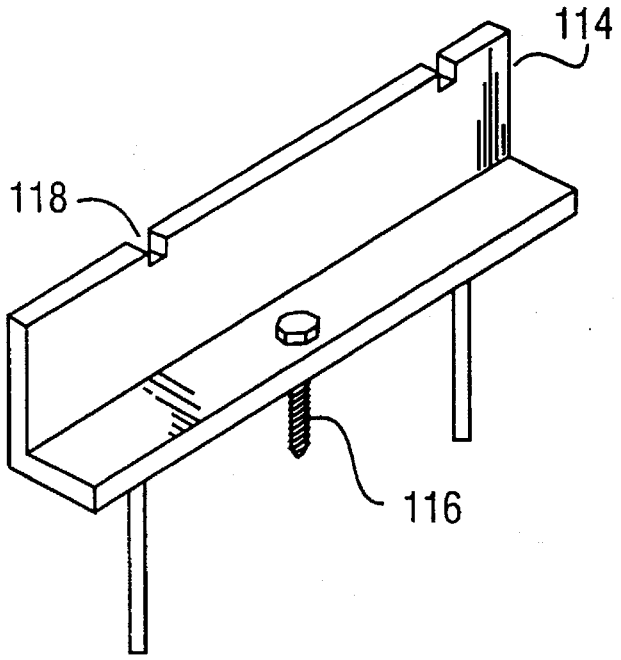
FIG. 22 is an isometric view of a cable bearing plate according to the present invention.

Vertical connecting line 32 extends upward from foundation anchor 54, through tubular conduit 24 placed within wall 10, and also encompassing roof panel structural facing material 132 as shown. Connecting line 32 extends over connecting line bearing plate 114 held with lag bolts 116 to wall top plate 50 as shown in FIGS. 20 and 22. Connecting line 32 extends through plate grooves 118 and along the top part of roof 108 and is thereby fastened onto the roof ridge anchor plate 122 with a locking tensioner anchor device 82. The locking tensioner anchor device 82 thereby applies tension to connecting line 32 and bears on roof ridge anchor plate 122 in compression. The locking tensioner anchor 82 applies tension to connecting line 32, and locks the connecting line in tension. Roof ridge anchor plate 122 is firmly held in place against braces or rafters placed within roof truss 108. The entire ridge line, including roof ridge anchor plate 122, anchor 82 and insulation material 126 is covered with roof cap plate 128 as shown in FIGS. 20 and 21. To complete the building structure, heating and/or air condition duct 140 may be included within attic area 142. At the base of rafter area 112 is a ceiling facing 134 (i.e., sheetrock, etc.)

Vertical connecting line 32 easily slides and tensions within the cavity formed between roof exterior finish surface 130 and roof structural facing material 132.

Figure 23:
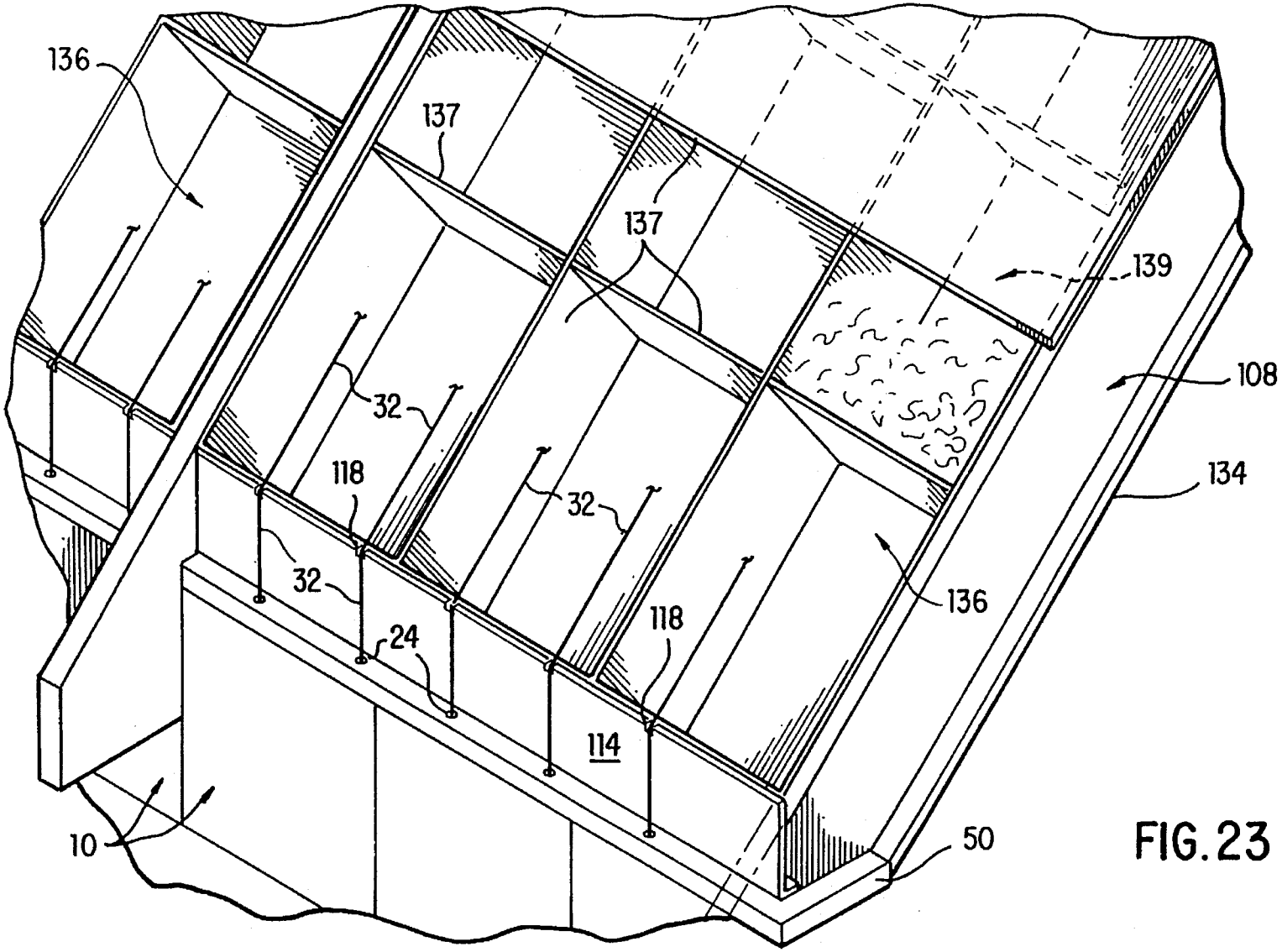
FIG. 23 is an isometric view of the roof panels of FIG. 20 according to the present invention.

FIG. 23 illustrates the roof section of a building similar to that shown in FIG. 20 having a detailed illustration of structural ribbed-panels 136 placed between flat roof trusses 108. The structural ribbed-panels 136 are glued and nailed to the flat roof trusses 108 creating a three dimensional structural system for the entire roof. The structural ribbed-panels and top and bottom facings 136 are made of oriented strand board or plywood 137 in their preferred embodiment. Each cell 139 is preferably filled with insulation (i.e., fiberglass, foam, etc.).

The embodiment of the wall/roof connection system for nonplanar blocks 10 and wall sections 40 may be similar to that shown for planar wall sections. Wall top plate 50 and connecting line bearing plate 114 may be fabricated following the non-linear top surface of the wall. Roof panels 136 may also be fabricated so that their lower ends would conform to the curvature of the top of the non-planar wall. In one embodiment, a cylindrical wall structure, for example, the top plate 50 and connecting line bearing plate 114, may be circular in plan view. Roof panels 136 may be shaped as a pie slice, with the apex of each panel at the peak of the roof. The ridge plate 122 may be replaced with a circular tensioning disc at the apex of the inverted cone roof surface.

Alternately, a roofing system for non-planar block walls may be constructed of planar or non-planar blocks. The regular or irregular-shaped blocks may be joined together with tensioned lines passing through block conduits.

The foregoing description of the present invention has been directed to particular preferred embodiments. It will be apparent, however, to those skilled in the art that modifications and changes in both building block design and building system design using a plurality of building blocks and roof panels may be made without departing from the scope and spirit of the invention. For example, equivalent elements may be substituted for those illustrated and described herein. Certain features of the invention may be utilized independently of the use of other features, all as would be apparent to one skilled in the art after having benefit of the description of the invention. As can be appreciated from the above discussion, the invention can present a practical advance over conventional building design for an improvement in time and money required for the construction of a building using light-weight, insulated building blocks placed with unskilled or semi-skilled labor. The building blocks are pre-fabricated and then easily transported to and placed at the construction site.

What is claimed is:

1. A modular system for making a building envelope with building blocks, comprising:

a plurality of building blocks placed substantially adjacent to one another to form the envelope, each block comprising a core with a pair of opposed surfaces, at least one cross strut placed through the core having two ends protruding from the surfaces, and at least one conduit attached to each end of the cross strut along the surface of the core such that the conduit conforms to its respective said surface of the core, and that the corresponding conduits in adjacent blocks are aligned to form a continuous conduit through the envelope;

a connecting line extending through the continuous conduit adjoining the building blocks; and at least one tensioning device for locking tension in the connecting line extending through the continuous conduit.

2. The system of claim 1 wherein the blocks are adapted to be stacked as a wall.

3. The system of claim 1 wherein the blocks are adapted to be stacked together to form a roof.

4. The system of claim 1 wherein the blocks each comprise a core with a pair of opposed surfaces, at least one cross strut, placed through the core having opposed ends protruding from the surfaces, and at least one conduit attached to each end of the cross strut such that the conduit is substantially parallel to at least part of a surface of the core.

5. The system of claim 1, further comprising a surface bond material placed on an exposed surface of the blocks.

6. The system of claim 4 wherein the blocks each further comprise a structural panel formed about each conduit and coupling its respective conduit to its respective said surface.

7. The system of claim 6, wherein the blocks each further comprise a reinforcing material connected to each conduit and bonded with its respective structural panel.

8. The system of claim 6, wherein the core comprises substantially rigid insulation material, each conduit comprises plastic, and each structural panel comprises concrete.

9. The system of claim 6 wherein the structural panel comprises concrete with a specific gravity less than 0.8.

10. The system of claim 1 wherein the connecting line is wire or cable.

11. The system of claim 1 wherein the system comprises a horizontal or vertical connecting line anchor adapted to be coupled to one end of the connecting line and a tension locking device adapted to be connected between the other end of the connecting line and a secure point on or proximate to the building envelope.

12. The system of claim 11 wherein the blocks are adapted to form a wall with said blocks stacked vertically above a foundation with a vertically disposed continuous conduit, and wherein the connecting line anchor comprises a substantially closed U-shaped metal track adapted to be anchored with the foundation and extending longitudinally beneath the wall, the track comprising a plurality of access ports arranged to receive said connecting line from the track and into the continuous conduit.

13. The system of claim 11 wherein the blocks are adapted to form a wall with said blocks stacked vertically above a foundation with a vertically disposed continuous conduit, and wherein the connecting line anchor comprises a substantially open U-shaped metal track adapted to be anchored and extending longitudinally within the foundation, and an anchor plate slidable within the track, said anchor plate including a plurality of openings along the track for receiving the connecting line from the conduit and into the track.

14. The system of claim 11 wherein the blocks are adapted to form a wall with said blocks stacked vertically above a foundation with a vertically disposed continuous conduit, and wherein the connecting line anchor comprises a U-shaped metal track adapted to be anchored and extend longitudinally within the foundation for receiving one end of the connecting line from the conduit into the track the one end comprising a butterfly adaptor with one-way flange adapted to extend outward and engage against the metal track after placement.

15. The system of claim 1 wherein the system further comprises a corner building block and a horizontal tension locking device adapted to be connected between one end of the connecting line and the outer surface of the corner building block.

16. The system of claim 1, further comprising a ridge anchor adapted to be connected to the connecting line and to distribute connecting line stress across ends of blocks, walls, roof panels, or trusses.

17. The system of claim 1, wherein the conduit is horizontal.

18. The system of claim 1, wherein the conduit is vertical.

19. The system of claim 1, wherein at least one conduit is horizontal and at least one conduit is vertical.

20. The system of claim 4, wherein the conduit is horizontal.

21. The system of claim 4, wherein the conduit is vertical.

22. The ststem of claim 4, wherein at least one conduit is horizontal and at least one conduit is vertical.

* * * * *